US006916217B1

(12) United States Patent
Crepeau

(10) Patent No.: US 6,916,217 B1
(45) Date of Patent: Jul. 12, 2005

(54) BOAT PROPELLER SHIELD SYSTEM

(75) Inventor: Felix H. Crepeau, Minnetonka, MN (US)

(73) Assignee: Omni Ventures, Inc., Minnetonka, MN (US)

( * ) Notice: Subject to any disclaimer, the term of this patent is extended or adjusted under 35 U.S.C. 154(b) by 19 days.

(21) Appl. No.: 10/799,856

(22) Filed: Mar. 12, 2004

(51) Int. Cl.[7] ..... B63H 5/16
(52) U.S. Cl. ..... 440/71; 150/154
(58) Field of Search ..... 440/71, 72; 150/154

(56) References Cited

U.S. PATENT DOCUMENTS

| | | | | |
|---|---|---|---|---|
| 2,985,133 A | | 5/1961 | Shaffer | 115/42 |
| 3,035,538 A | | 5/1962 | Willard | 115/42 |
| 4,565,533 A | | 1/1986 | Springer | 440/71 |
| 4,680,017 A | | 7/1987 | Eller | 440/66 |
| D322,593 S | | 12/1991 | Kearney et al. | D12/214 |
| 5,213,525 A | | 5/1993 | Sanford | 440/49 |
| 5,246,345 A | | 9/1993 | Adams, Jr. | 416/247 |
| D344,456 S | * | 2/1994 | Argondizza | D9/420 |
| 5,494,465 A | | 2/1996 | Jenkins | 440/71 |
| D372,079 S | * | 7/1996 | Fago et al. | D23/365 |
| 5,664,975 A | * | 9/1997 | Carlisle | 440/49 |
| 6,162,104 A | | 12/2000 | White | 440/71 |
| 6,478,640 B1 | | 11/2002 | Raps | 440/72 |
| 2001/0036776 A1 | | 11/2001 | Raps | 440/72 |
| 2003/0017763 A1 | | 1/2003 | Miller | 440/71 |

FOREIGN PATENT DOCUMENTS

| | | | | |
|---|---|---|---|---|
| WO | WO 3049993 A1 * | 6/2003 | | B63B/17/00 |

OTHER PUBLICATIONS

Prop–Protect Propeller Cover Feb. 10, 2004 Mengo–ind-.com Website printout 1 page.

* cited by examiner

*Primary Examiner*—Jesus D. Sotelo

(57) ABSTRACT

A boat propeller shield system for protecting a propeller from damage and humans from injury. The boat propeller shield system includes a cover, a front opening within the cover and a zipper extending from a perimeter of the front opening. The cover is preferably constructed of a resilient material such as neoprene.

11 Claims, 9 Drawing Sheets

BOAT PROPELLER SHIELD SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to propeller covers and more specifically it relates to a boat propeller shield system for protecting a propeller from damage and humans from injury.

2. Description of the Related Art

Boat propellers are utilized within a boat (inboard, outboard and inboardoutboard) for driving the boat forwardly and rearwardly. Boat propellers have a plurality of blades that are balanced to create an optimal performance when in the water. The propeller blades are easily damaged when the boat is removed from the water (e.g. engaging the ground, objects, etc.). In addition, the propeller blades can cause significant injury to individuals that make contact with the propeller.

While these devices may be suitable for the particular purpose to which they address, they are not as suitable for protecting a propeller from damage and humans from injury. Propellers are susceptible to damage when removed from the water and are capable of causing injury to humans when exposed.

In these respects, the boat propeller shield system according to the present invention substantially departs from the conventional concepts and designs of the prior art, and in so doing provides an apparatus primarily developed for the purpose of protecting a propeller from damage and humans from injury.

BRIEF SUMMARY OF THE INVENTION

In view of the foregoing disadvantages inherent in the known types of boat propellers now present in the prior art, the present invention provides a new boat propeller shield system construction wherein the same can be utilized for protecting a propeller from damage and humans from injury.

To attain this, the present invention generally comprises a cover, a front opening within the cover and a zipper extending from a perimeter of the front opening. The cover is preferably constructed of a resilient material such as neoprene.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a boat propeller shield system that will overcome the shortcomings of the prior art devices.

A second object is to provide a boat propeller shield system for protecting a propeller from damage and humans from injury.

Another object is to provide a boat propeller shield system that fits upon various sizes and types of propellers.

An additional object is to provide a boat propeller shield system that is easily attached about a conventional propeller.

A further object is to provide a boat propeller shield system that inboard, outboard and inboard/outboard boats.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
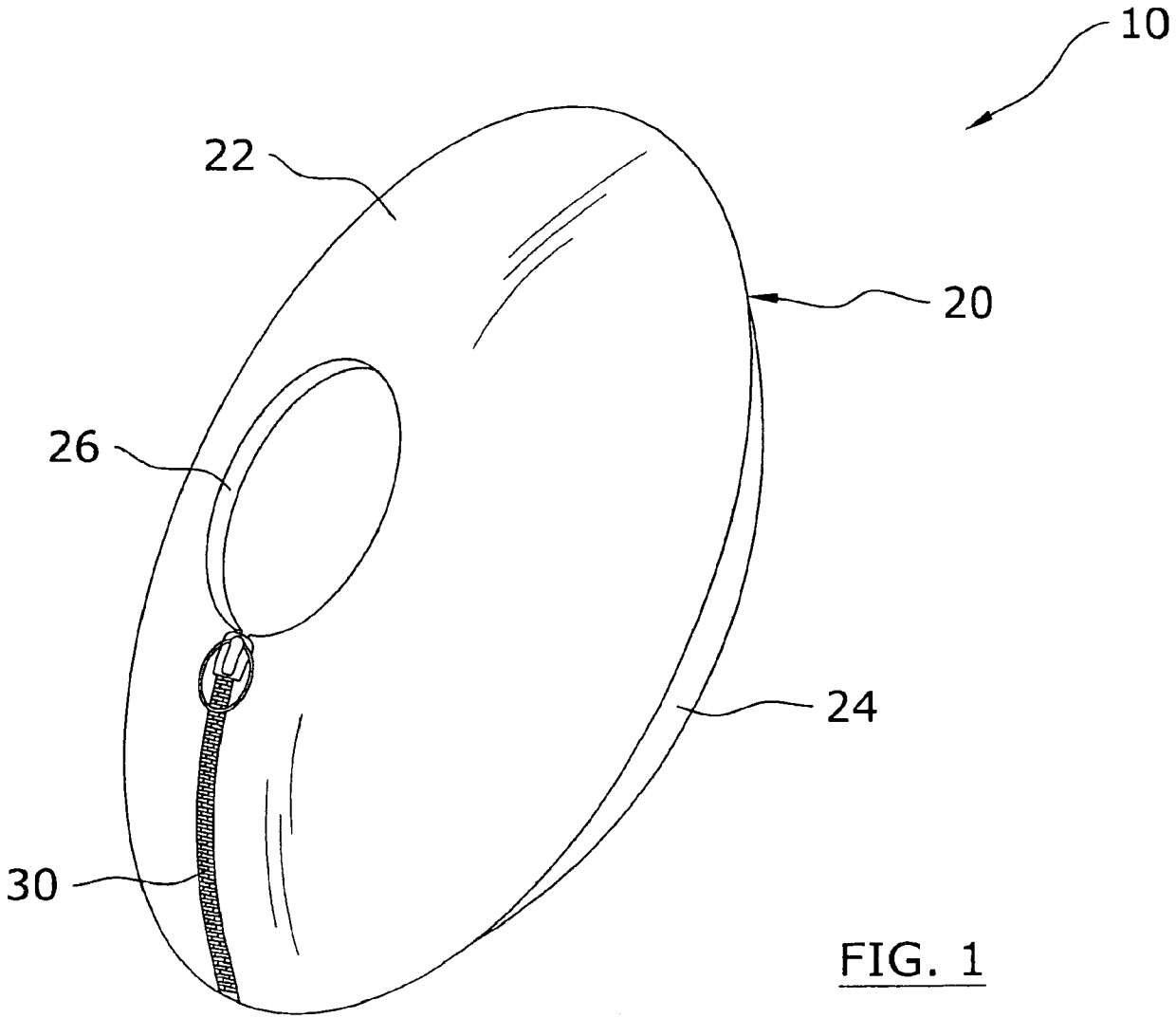
FIG. 1 is an upper perspective view of the present invention.

Turning now descriptively to the drawings, in which similar reference characters denote similar elements throughout the several views, FIGS. 1 through 9 illustrate a boat propeller shield system 10, which comprises a cover 20, a front opening 26 within the cover 20 and a zipper 30 extending from a perimeter of the front opening 26. The cover 20 is preferably constructed of a resilient material such as neoprene.

B. Cover

Figure 2:
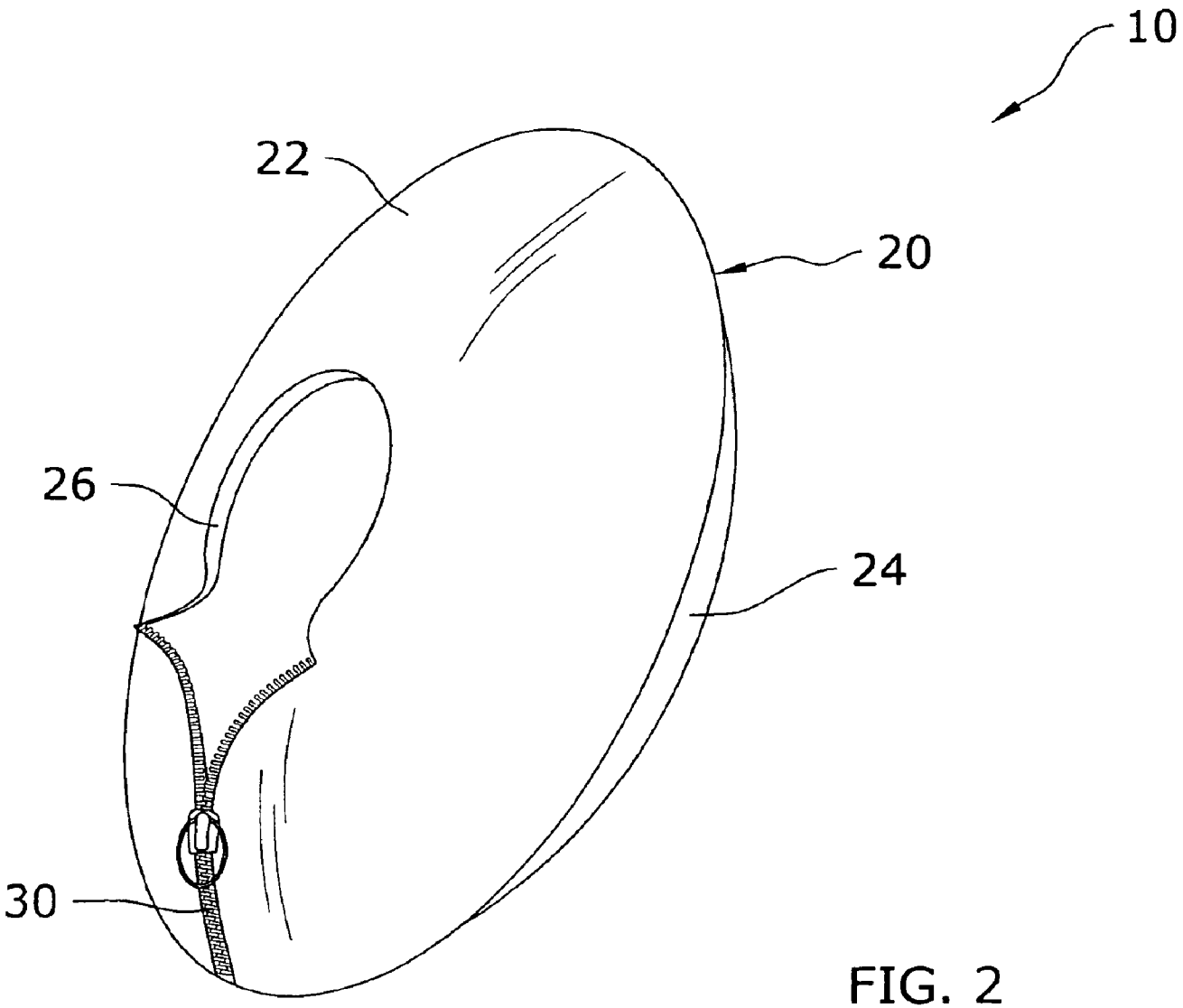
FIG. 2 is an upper perspective view of the present invention with the zipper partially opened.

The cover 20 has an interior cavity for receiving a propeller 12 as shown in FIGS. 1 and 2 of the drawings. The cover 20 may have various shapes, however the cover 20 is preferably comprised of a circular shape which conforms to the outer perimeter of the propeller 12.

Figure 3:
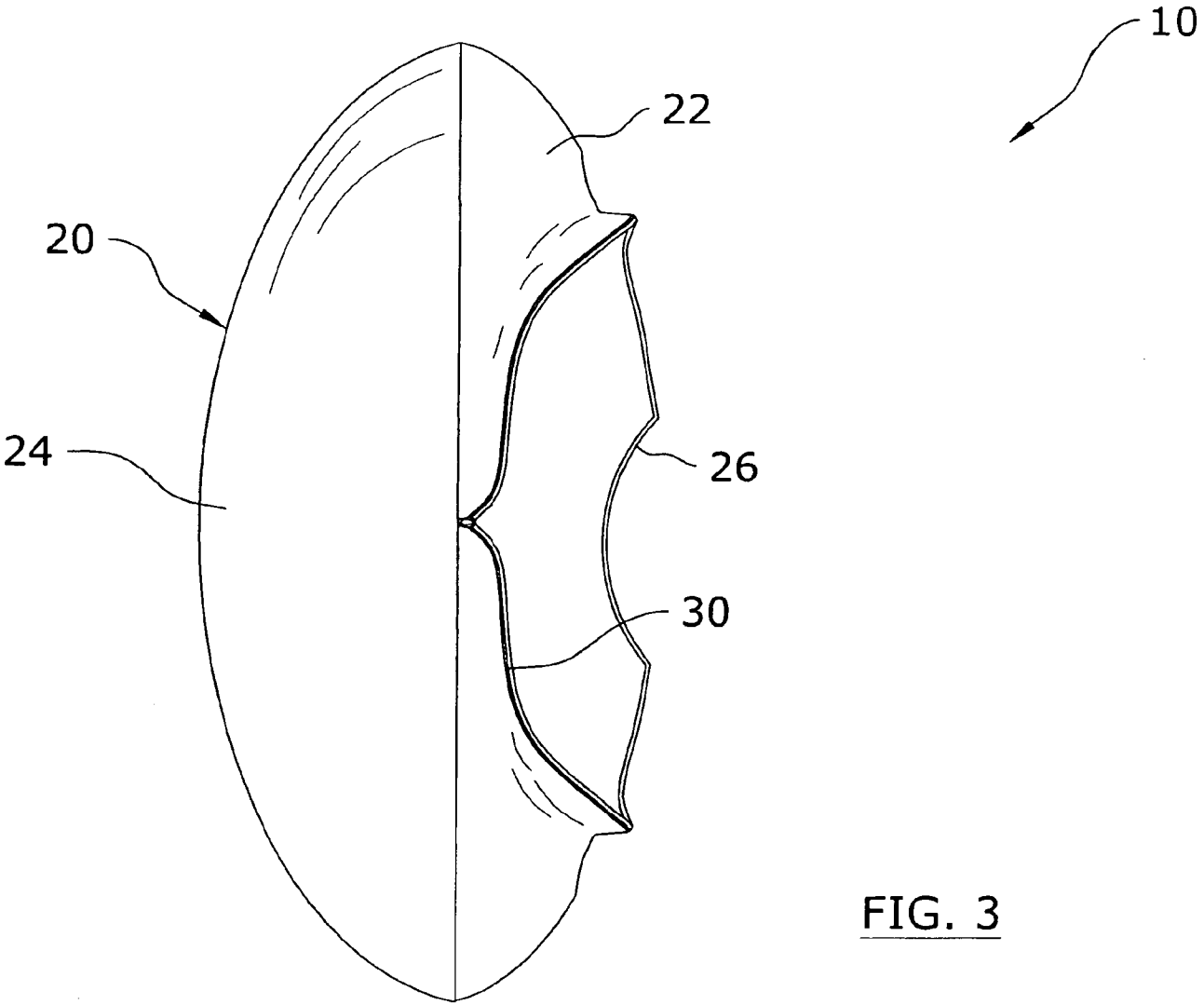
FIG. 3 is a side view of the present invention with the zipper fully opened.

The cover 20 includes a front portion 22 and a rear portion 24 opposite of the front portion 22 as shown in FIGS. 1 through 3 of the drawings. The front portion 22 and the rear portion 24 are preferably each comprised of a convex structure as best illustrated in FIG. 3 of the drawings.

Figure 8:
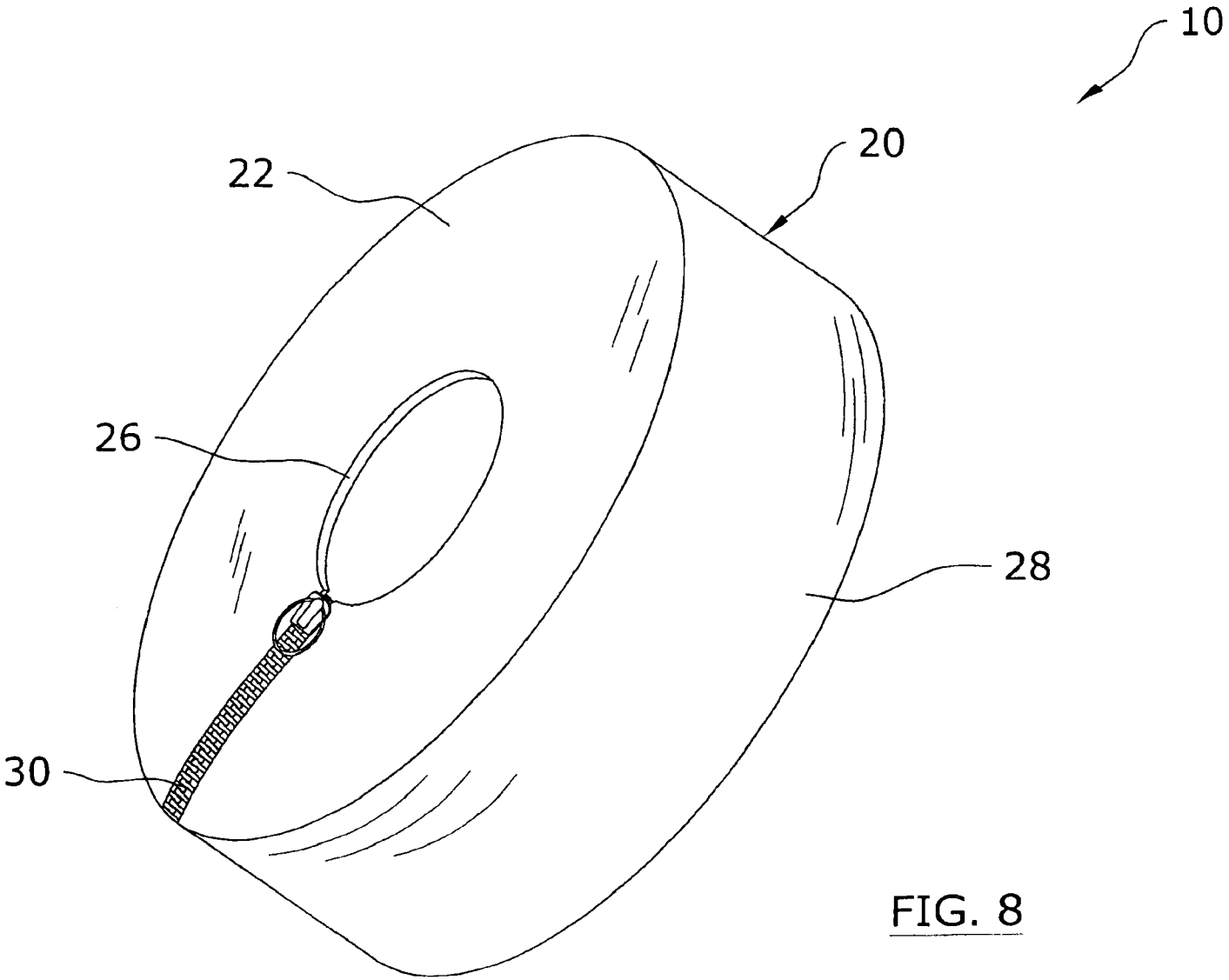
FIG. 8 is an upper perspective view of an alternative embodiment of the present invention.
Figure 9:
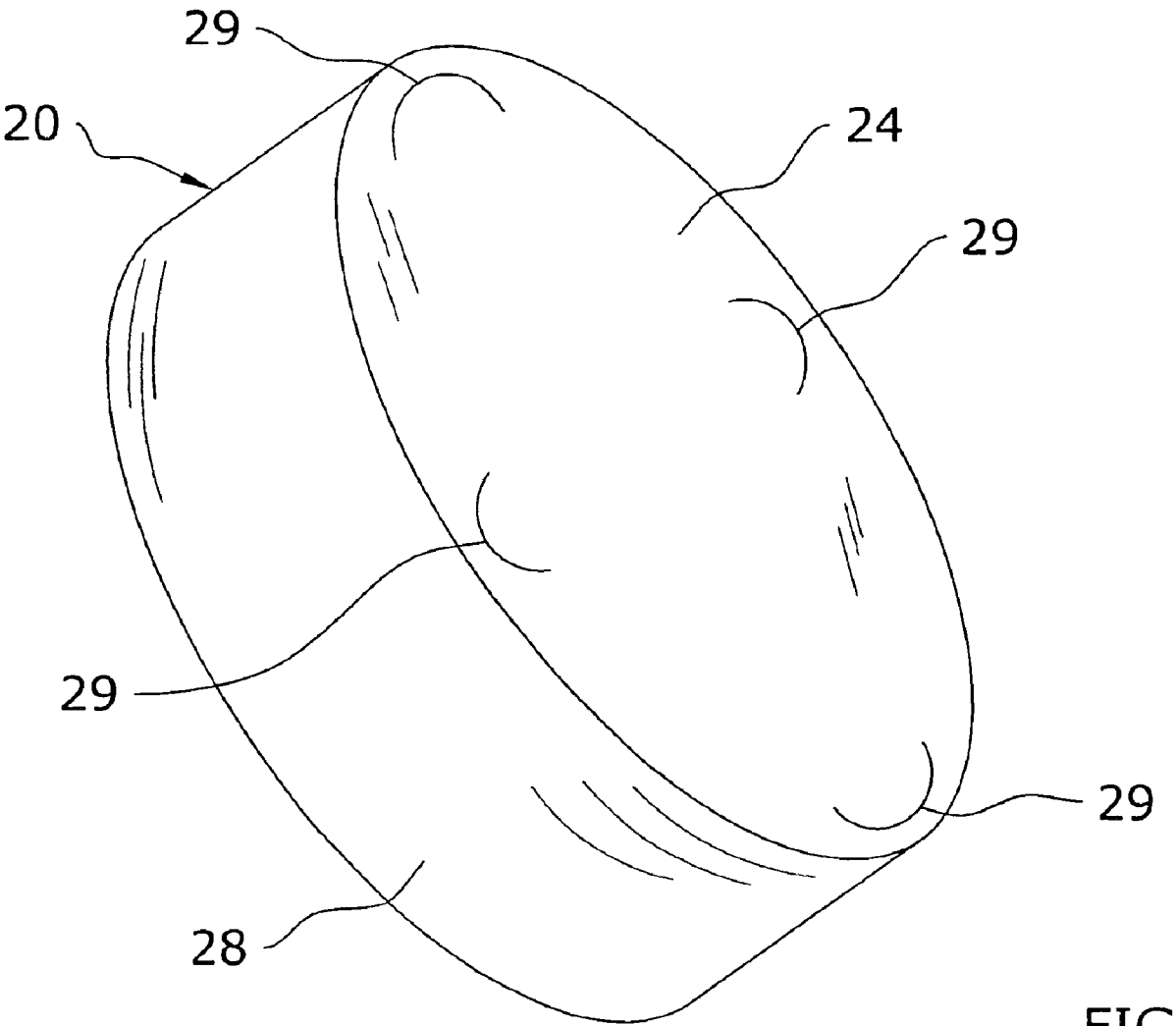
FIG. 9 is an upper rear perspective view of the alternative embodiment illustrating the C-shaped slots within the rear portion of the cover.

In an alternative embodiment as shown in FIGS. 8 and 9 of the drawings, the cover 20 includes a middle portion 28 between the front portion 22 and the rear portion 24. The middle portion 28 is comprised of a substantially transverse structure with respect to the front portion 22 and the rear portion 24 as shown in FIGS. 8 and 9. In addition, the front portion 22 and the rear portion 24 are preferably substantially parallel to one another in the alternative embodiment.

The cover 20 is preferably constructed of a resilient and padded material. The inventor has determined that the cover 20 is preferably constructed of synthetic rubber such as but not limited to neoprene.

As shown in FIG. 9 of the drawings, the rear portion 24 preferably at least one slot for allowing water to drain from the interior of the cover 20 and for allowing air movement when the boat is being transported. The slots 29 are preferably comprised of a curved shape forming a C-shaped flap as shown in FIG. 9.

However, the slots 29 may have various other shapes. In addition, apertures and various other types of openings may be positioned within the cover 20 for allowing drainage of water from the interior of the cover 20.

C. Front Opening

A front opening 26 extends within a front portion 22 of the cover 20 as shown in FIG. 1 of the drawings. The front opening 26 is preferably centrally positioned within the front portion 22.

Figure 4:
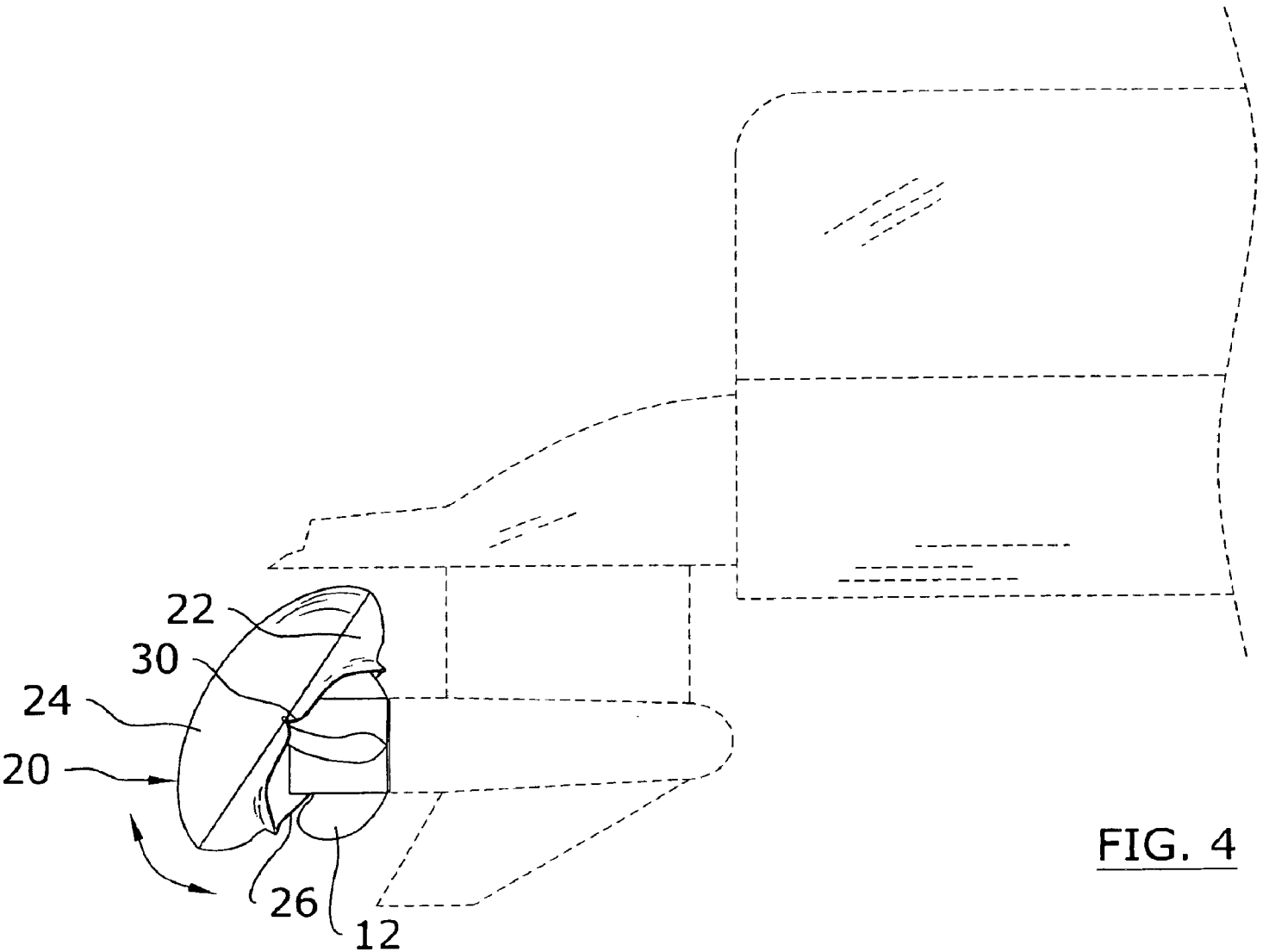
FIG. 4 is a side view of the present invention partially positioned upon a propeller.
Figure 5:
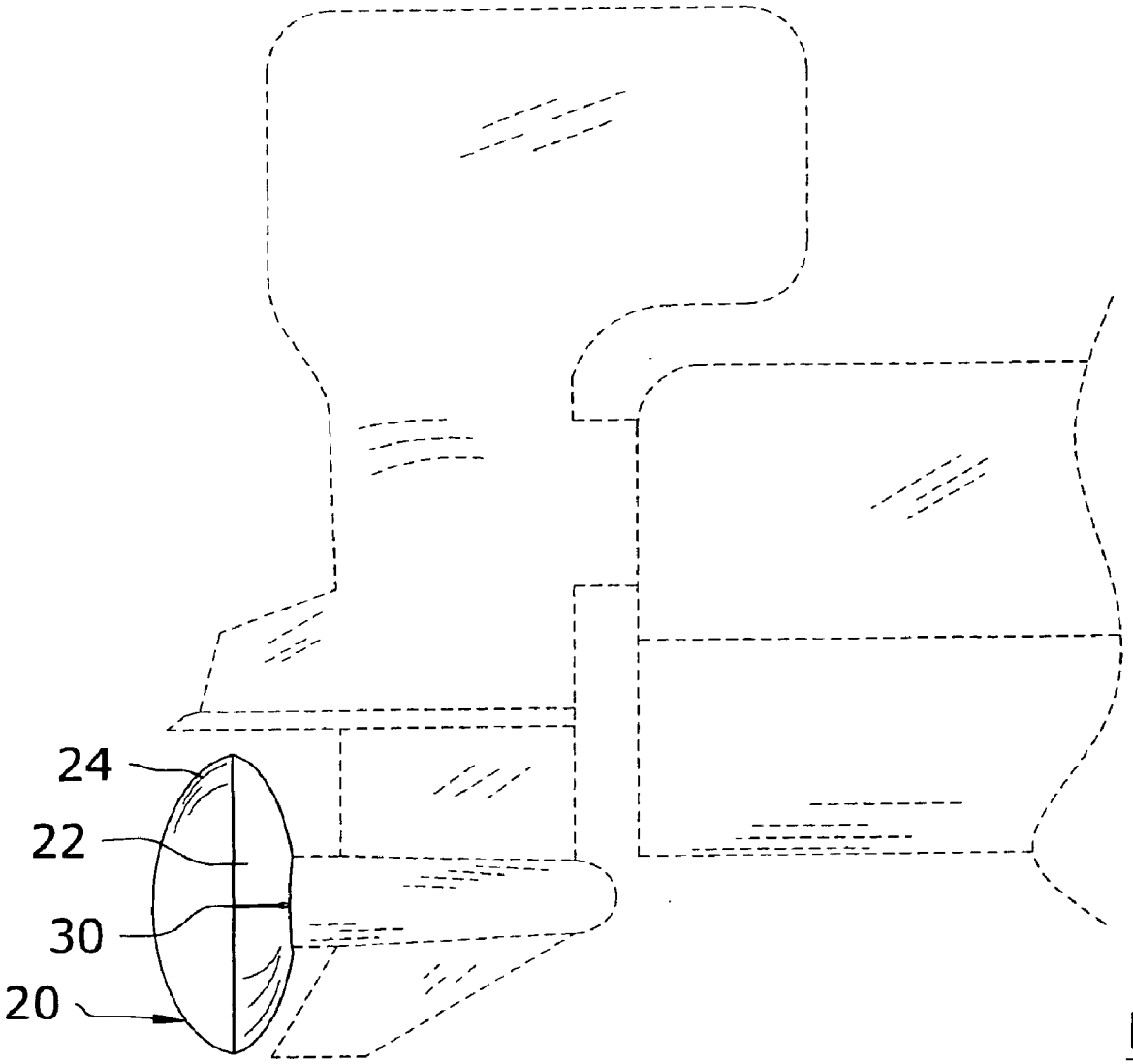
FIG. 5 is a side view of the present invention fully positioned upon a propeller of an outboard motor.

The front opening 26 is preferably formed of a circular shape having a diameter sufficient to receive the tubular portion of the propeller 12 as shown in FIGS. 4 and 5 of the drawings. The front opening 26 is preferably formed to have a relatively snug fit about the tubular portion of the propeller 12.

D. Front Slit and Fastener

A front slit extends from a perimeter of the first opening and a fastener is attached to the cover 20 for selectively securing the slit as shown in FIGS. 2 and 3 of the drawings. The front slit allows for the expansion of the front portion 22 and front opening 26 for allowing positioning about or removal from the propeller 12. The front slit preferably extends radially from the front opening 26 as best illustrated in FIG. 2 of the drawings.

The fastener is preferably comprised of a zipper 30 structure as shown in FIGS. 1 and 2 of the drawings. The zipper 30 opens from the front opening 26 toward the outer portion of the cover 20 as shown in FIG. 2 of the drawings. Other fasteners may be utilized to secure the front slit, however the zipper 30 is preferably utilized for providing complete closing of the cover 20 about the propeller 12.

E. Operation of Invention

In use, the user first opens the front slit within the cover 20 by opening the zipper 30 as shown in FIGS. 2 and 3 of the drawings. After the slit is opened sufficiently, the user then positions the cover 20 about the propeller 12 as shown in FIG. 4 of the drawings.

Figure 6:
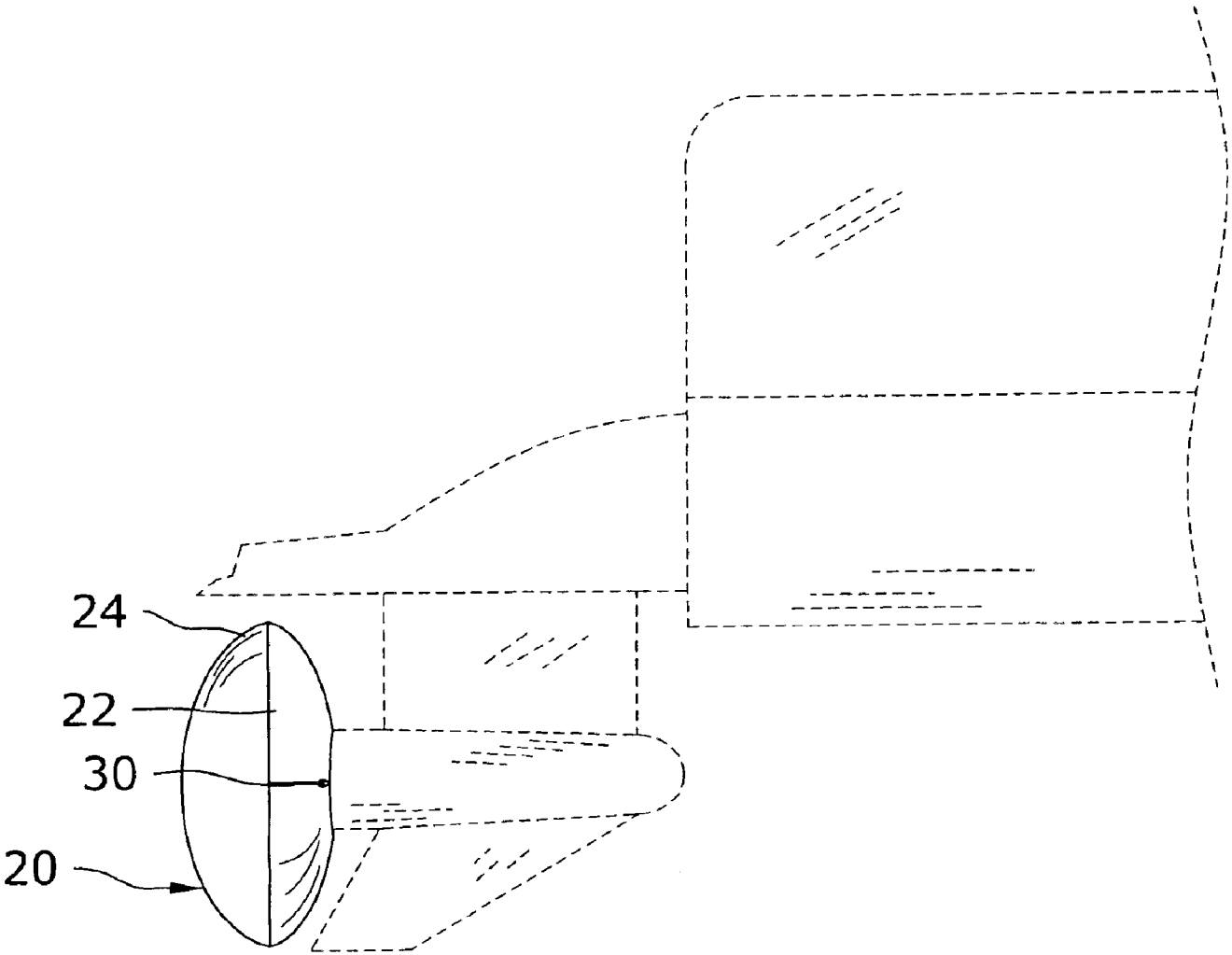
FIG. 6 is a side view of the present invention fully positioned upon a propeller of an inboard motor.
Figure 7:
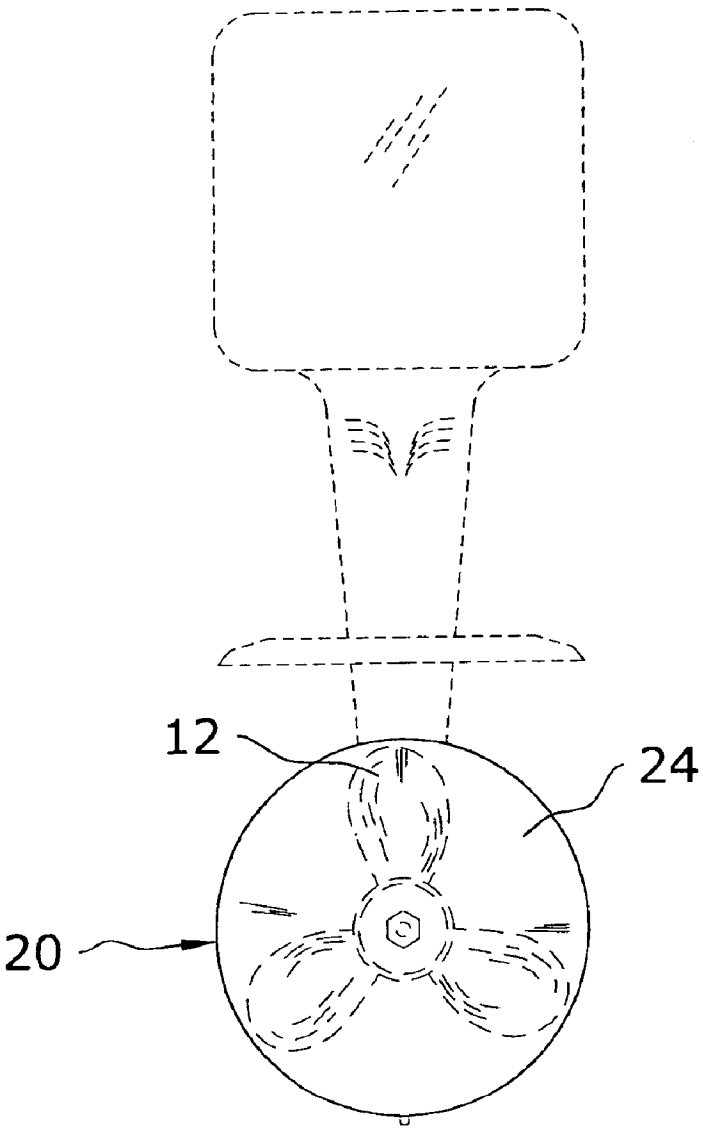
FIG. 7 is a rear view of the present invention attached to a propeller.

After the cover 20 is positioned upon the propeller 12, the user then closes the zipper 30 thereby causing the cover 20 to be retained upon the propeller 12 as shown in FIGS. 5 and 6 of the drawings. The cover 20 protects the propeller 12 from damage and users from injury. To remove the cover 20 from the propeller 12, the user simply opens the zipper 30 and then removes the cover 20 from the propeller 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A boat propeller shield system, comprising:

a cover having an interior cavity for receiving a propeller;

a front opening within a front portion of said cover;

wherein said cover includes a rear portion opposite of said front portion and wherein said rear portion includes at least one slot;

a slit extending from a perimeter of said first opening; and a fastener attached to said cover for selectively securing said slit.

2. The boat propeller shield system of claim 1, wherein said cover is constructed of a resilient material.

3. The boat propeller shield system of claim 1, wherein said cover is constructed of neoprene.

4. The boat propeller shield system of claim 1, wherein said cover has a circular shape.

5. The boat propeller shield system of claim 1, wherein said cover includes a middle portion between said front portion and said rear portion.

6. The boat propeller shield system of claim 5, wherein said front portion and said rear portion are substantially parallel to one another.

7. The boat propeller shield system of claim 1, wherein said at least one slot is comprised of a curved shape.

8. The boat propeller shield system of claim 1, wherein said fastener is comprised of a zipper structure.

9. The boat propeller shield system of claim 1, wherein said front opening is comprised of a circular shape.

10. The boat propeller shield system of claim 1, wherein said front portion has a convex structure.

11. A boat propeller shield system, comprising:

a cover including a front portion and a rear portion having a circular shape and an interior cavity for receiving a propeller, wherein said cover is comprised of neoprene, and wherein said front portion and said rear portion each have a convex structure;

a front opening within a front portion of said cover, wherein said front opening has a circular shape;

wherein said cover includes a rear portion opposite of said front portion and wherein said rear portion includes at least one slot;

a slit extending from a perimeter of said first opening; and a zipper attached to said cover for selectively securing said slit.

* * * * *